United States Patent [19]

Kirkel

[11] 4,033,486

[45] July 5, 1977

[54] ANTI-FOAMING ASSEMBLY AND METHOD

[75] Inventor: David L. Kirkel, Mount Prospect, Ill.

[73] Assignee: Seaquist Valve Company, Cary, Ill.

[22] Filed: Nov. 13, 1975

[21] Appl. No.: 631,667

[52] U.S. Cl. ..... 222/190

[51] Int. Cl.² ..... B67D 5/58

[58] Field of Search ..... 222/190, 571, 108; 252/358, 361, 18, 19, 21; 239/104, 120

[56] References Cited

UNITED STATES PATENTS

| | | | |
|---|---|---|---|
| 3,179,290 | 4/1965 | Whitney | 222/571 X |
| 3,226,040 | 12/1965 | Briechle et al. | 239/573 X |
| 3,325,034 | 6/1967 | Squire | 222/571 |
| 3,423,234 | 1/1969 | Heine | 222/571 X |
| 3,775,339 | 11/1973 | Kasulin et al. | 252/361 |

*Primary Examiner*—Stanley H. Tollberg
*Attorney, Agent, or Firm*—Stefan M. Stein

[57] ABSTRACT

A fluid dispensing assembly comprising a terminal orifice assembly having a terminal orifice aperture or element therein from which fluid from the dispensing container on which the dispensing assembly is mounted, issued, wherein an anti-foaming composition is disposed on the exterior surface of the terminal orifice assembly adjacent and/or contiguous to the terminal orifice so as to immediately engage fluid product issuing from the terminal orifice in order to reduce and/or eliminate any foaming of the fluid product. The anti-foaming composition includes a surface tension reducing ingredient therein wherein the anti-foaming composition is applied in solution to the exterior surface contiguous the terminal orifice.

10 Claims, 6 Drawing Figures

FIG. 1
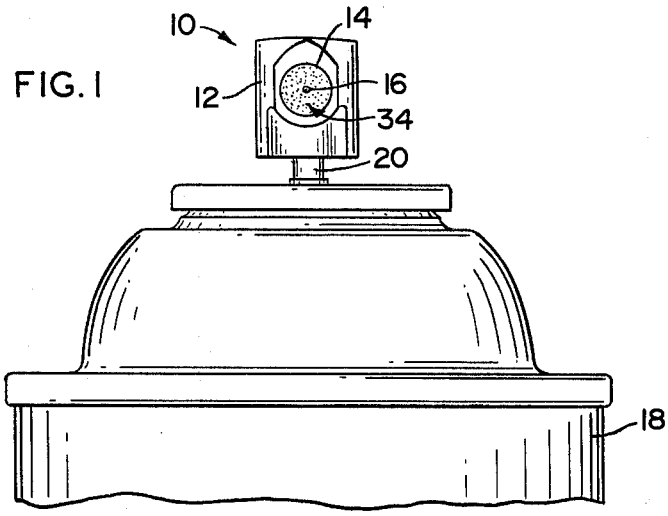
FIG. 3
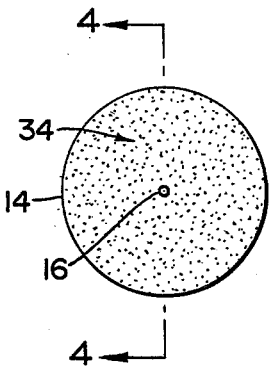
FIG. 2
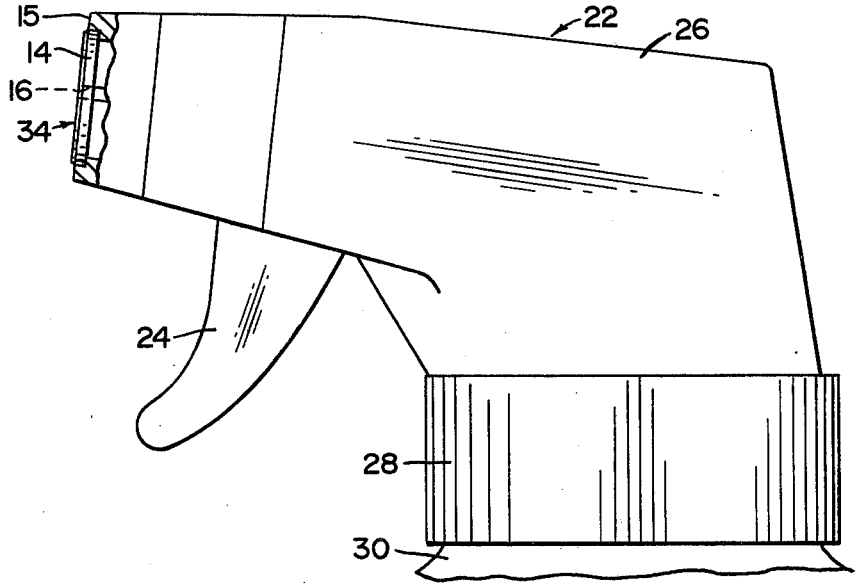
FIG. 4
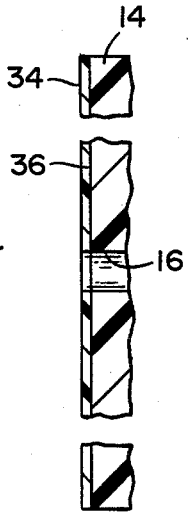
FIG. 5
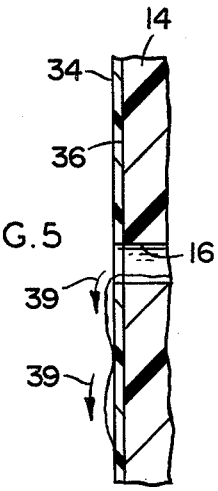
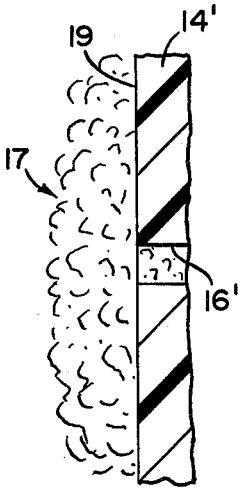
FIG. 6
(PRIOR ART)

ANTI-FOAMING ASSEMBLY AND METHOD

BACKGROUND OF THE INVENTION

1. Field of the Invention

This invention relates to a fluid dispensing assembly including a terminal orifice assembly having a terminal orifice formed therein from which fluid product issues wherein the exterior surface immediately adjacent and/or contiguous to the terminal orifice is coated with a predetermined composition in order to essentially eliminate or reduce foaming of the fluid product issuing from the terminal orifice. 2. Description of the Prior Art In the dispensing industry fluid dispensing structures must be designed to accomplish desired spray characteristics. Such designed structure is often dependent upon the particular type of fluid product being dispensed. This is often times true irrespective of whether the fluid dispensing assembly is of the aerosol type, commonly utilizing a valve button or is of the finger pump type wherein a specifically designed and configured terminal oriface insert is utilized.

Frequently, a specific design for a fluid dispensing assembly will be capable of effecting desired spray characteristics such as spray pattern, consistancy of product, etc. However, there are certain secondary products which frequently have to be considered when judging the overall acceptability of a fluid dispensing structure.

For instance, in the dispensing of water base detergent type products from either an aerosol or finger pump type dispensing structure the problem of "after foam" frequently occurs. For purposes of clarity "after foam" may here and be defined but not limited to the situation where foam continues to issue from the terminal orifice of the dispensing structure after actuation of the dispensing structure has been terminated and after the intended amount of product has been dispensed. This after foam collects on the exterior surface or face of the fluid dispensing structure adjacent the terminal orifice causing a residual foam build-up of the fluid product. Such foam build-up is undesirable and unsatisfactory for a number of obvious reasons.

Accordingly, it it obvious that solving of this after foam problem in a manner which would still allow the fluid dispensing structure to be designed in a manner to accomplish the primary spray pattern or other operating characteristics, would be highly desirable.

Accordingly, elimination or reduction of the after foam problem without major structural modifications to the fluid dispensing assembly itself would be highly desirable. Such desirability would be evident both from a cost in maintenance standpoint.

SUMMARY OF THE INVENTION

This invention relates to a fluid dispensing assembly incorporating a terminal orifice assembly having a terminal orifice formed therein from which fluid product issues. An anti-foaming composition is disposed on the exterior surface immediately contiguous to or adjacent to the terminal orifice so as to come into direct fluid engagement with fluid product issuing from the terminal orifice.

More particularly, a fluid dispensing assembly may take the form of either an aerosol button of the type used with a conventional fluid dispensing container in the form of an aerosol dispensing can or alternately a finger activated pump mechanism. The latter embodiment may also be of conventional design but is mounted on a fluid dispensing container housing a fluid product therein.

Here respective of the particular structural embodiment utilized the particular fluid dispensing assembly comprises a terminal orifice assembly which may be integrally or removably attached to either the valve button or finger operated pump, dependent upon the embodiment utilized.

The terminal orifice assembly includes a terminal orifice insert comprising at least one terminal orifice formed in the assembly and disposed in fluid communication with the rest of the dispensing structure generally and with the fluid product mantained within the container specifically.

An important feature of the present invention comprises the provision of an anti-foaming composition disposed on a predetermined portion of the exterior surface of the terminal orifice assembly adjacent to or contiguous the terminal orifice means formed in the terminal orifice assembly. Disposition of the anti-foaming composition is such as to come into direct contact with fluid issuing from the terminal orifice means as it exits from the interior of the fluid dispensing assembly.

Application of the coating of anti-foaming composition preferably occurs by submerging the terminal orifice assembly in a bath of solution for a period of 10 minutes and then agitating the bath. One specific example included the immersing of a plurality of terminal orifice assemblies in a solution consisting of: 5% by weight DB-100 fluid (Dow Corning) and 95% by weight Fluorocarbon 11 (Freon) the bath was agitated and after agitation the terminal orifice assemblies were removed and dried prior to assembly in the remainder of the fluid dispensing assembly.

A second example of application of the anti-foaming composition included inserting the terminal orifice assemblies directly in the fluid dispensing assembly and then dabbing or manually applying the faces or exterior of the terminal orifice assemblies contiguous to the terminal orifice by means of a wick immersed in a solution of the anti-foaming composition consisting of: 2% by weight DB-100 fluid (Dow Corning) and 98% by weight Fluorocarbon 11 (Freon).

Before installation of the terminal orifice assembly into the remainder of the fluid dispensing assembly each of the exterior surfaces were sprayed with an aerosol consisting of by weight 2% DB-100 fluid (Dow Corning), 69% Fluorocarbon 11 (Freon), and 29% Fluorocarbon 12 (Freon).

All of the above methods of application of the anti-foam composition yielded excellent results in eliminating or essentially reducing after foam. While not intended to be limiting, the following compositions may be utilized as the prime silicone derivative ingredient in the anti-foaming composition. It should be further pointed out that an important operative feature of the designated compositions is their ability to reduce surface tension over the exterior surface of the terminal orifice assembly contiguous or adjacent to the terminal orifice from which the fluid product issues. Applicable silicon derivative ingredients include General Electric AF-72 aqueous silicone emulsions and General Electric AF-70 silicone fluid. For full disclosure of utilization and composition of the above-noted substances, see the *General Electric Technical Data Book*, S-12C entitled "Silicones—Antifoams." Similarly Dow Corning DB- 100 anti-foam compound-compound silicone fluid as disclosed in Dow Corning's bulletin, 22-033, dated December, 1970 entitled "Information About Anti-foam Materials."

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a front plan view of a fluid dispensing assembly in the form of an aerosol button mounted on a fluid dispensing container in the form of a conventional aerosol container.

FIG. 2 is another embodiment of the fluid dispensing assembly of the present invention in the form of a finger activated pump mechanism showing the terminal orifice assembly and/or insert in partial cutaway sections.

FIG. 3 is a front detailed view of the exterior surface contiguous or adjacent to the terminal orifice in the terminal orifice assembly having the anti-foam composition mounted thereon.

FIG. 4 is a sectional view of the detailed structure as shown in FIG. 3 showing the anti-foam composition mounted on the exterior surface of the terminal orifice assembly contiguous the terminal orifice.

FIG. 5 is a schematic representation done in detailed sections showing the effect of the anti-foam composition on the fluid product issuing from the terminal orifice.

FIG. 6 is a sectional, detailed view showing prior art structure.

Similar reference characters refer to similar parts throughout the several views of the drawings.

DETAILED DESCRIPTION

As shown in FIG. 1 the fluid dispensing assembly is generally indicated as 10 and is disclosed in the form of an aerosol button 12 having a terminal orifice assembly 14 formed in the face thereof. A terminal orifice means comprising a single terminal orifice 16 is formed in the terminal orifice assembly and is disposed in direct fluid communication with the remainder of the fluid dispensing assembly and specifically in fluid communication with the fluid product on the interior of the dispensing container 18. As in conventional structure a valve stem 20 has the button 12 mounted thereon and establishes fluid communication between the interior of the container 18 and the interior of the button 12 as well as the terminal orifice means 16.

With reference to FIG. 2 the fluid dispensing assembly is generally indicated as 22 and is represented in the form of a finger operated pump mechanism. More specifically, a finger activated trigger 24 is movably attached to the housing or casing 26 wherein conventional attachment means 28 in the form of a threaded ring serves to attach the casing 26 to the fluid dispensing container 30. For purposes of clarity, the structure relating to the terminal orifice means and the terminal orifice assembly will be represented by similar reference numerals relative to the discussion between the embodiments of FIGS. 1 and 2. Accordingly, the terminal orifice assembly 14 may be in the form of an insert designed to be press fitted in the terminal extremity of the casing 26 as at 15. Terminal orifice means 16 includes a single terminal orifice integrally formed in the terminal orifice assembly and disposed in direct fluid communication with the interior of the casing 26 and the fluid product within the fluid dispensing container 30.

With reference to FIG. 6 a single terminal orifice 16' is shown as being formed in a terminal orifice assembly 14' wherein fluid product issues from the terminal orifice 16' and, dependent upon the specific composition of the fluid product may have a tendency to "after foam" causing residue foam generally indicated as 17 to form on the exterior surface 19 of the terminal orifice assembly 14'. The present invention is specifically designed to eliminate the after foam problem as will be described in greater detail hereinafter.

With reference to FIGS. 3, 4 and 5 an anti-foaming composition 34 is disposed on the exterior surface 36 of the terminal orifice assembly 14 adjacent to or contiguous the terminal orifice means comprising the single terminal orifice 16.

In operation actuation of the fluid dispensing assembly 10 or 22, depending on the particular embodiment utilized, causes fluid product to issue from the interior of the respective container 18 or 30 through the terminal orifice means 16 in the desired spray pattern, etc. After actuation has stopped and when dispensing water base or detergent type products foam has a tendency to continue to come out of the fluid dispensing assembly through the terminal orifice 16 and remain on the exterior surface or face of the terminal orifice assembly 14 and build up a residual foam 17 (FIG. 6). Through the provision of the anti-foam coating or composition 34 disposed on the exterior surface 36, the fluid product indicated by arrows 39 will have a tendency to pass down the face or surface 36 upon leaving the terminal orifice due to the face that the anti-foam composition 34 lowers the surface tension on the face or surface 36 so that the residual foam collection could no longer develop.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A terminal orifice assembly for use with aerosol and finger pump type dispensers, said assembly having terminal orifice means formed therein and an anti-foaming composition disposed in continguous relation to said terminal orifice means and in communicating relation with foam issuing from said terminal orifice means, said anti-foaming composition being disposed on the exterior surface of said assembly adjacent said terminal orifice means.

2. The terminal orifice assembly of claim 1 wherein said anti-foaming composition comprises a surface tension reducing ingredient therein.

3. The terminal orifice of claim 1 wherein said anti-foaming composition includes a silicone derivative therein.

4. The terminal orifice assembly of claim 1 wherein said terminal orifice means comprises an insert, said anti-foaming composition disposed on the exterior surface of insert.

5. The terminal orifice assembly of claim 4 further omprising a valve button, said insert being mounted on said valve button, whereby fluid is dispensed from said valve button through said insert.

6. A terminal orifice assembly for use with aerosol and finger pump type dispensers, said assembly having terminal orifice means formed therein and an anti-foaming composition disposed in contiguous relation to said terminal orifice means and in communicating relation with foam issuing from said terminal orifice means, said anti-foaming composition comprising a solution consisting of a minor portion by weight silicone derivative and a major portion by weight fluorcarbon.

7. A method of producing an anti-foaming terminal orifice assembly for use with aerosol and finger pump type dispensers said method comprising:

a. applying a surface tension reducing composition to the exterior surface of the assembly adjacent the terminal orifice;

b. drying the surface tension reducing composition adjacent the terminal orifice;

c. depositing the surface tension reducing composition in direct fluid engagement with the product issuing from the terminal orifice, whereby the foaming of the product issued from the assembly is reduced through reduction of the surface tension of fluid product engaging the surface substantially adjacent the terminal orifice.

8. The method of claim 1 wherein application of said surface tension reducing composition comprises immersing said terminal orifice insert in a bath of said surface tension reducing composition for a predetermined period.

9. The method of claim 8 wherein said terminal orifice insert is agitated while immersed in said bath.

10. The method as in claim 7 further comprising forming said surface tension reducing composition at least in part from a polysiloxane compound.

* * * * *

UNITED STATES PATENT OFFICE

CERTIFICATE OF CORRECTION

Patent No. 4,033,486 Dated July 5, 1977

Inventor(s) David L. Kirkel

It is certified that error appears in the above-identified patent and that said Letters Patent are hereby corrected as shown below:

| | |
|---|---|
| Col. 1, line 26: | "consistancy" should read --consistency- |
| Col. 2, line 40 | after "exterior" insert --surfaces-- |
| Col. 4, line 40 | "face" should read --fact-- |

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*